US007261480B2

(12) United States Patent
Hampton et al.

(10) Patent No.: US 7,261,480 B2
(45) Date of Patent: Aug. 28, 2007

(54) PRINT SHAFT CONTAMINATION DETECTOR

(75) Inventors: Edward F. Hampton, Woodbury, CT (US); Keith M. Smith, Fairfield, CT (US)

(73) Assignee: Pitney Bowes Inc., Stamford, CT (US)

( * ) Notice: Subject to any disclaimer, the term of this patent is extended or adjusted under 35 U.S.C. 154(b) by 262 days.

(21) Appl. No.: 10/996,219

(22) Filed: Nov. 23, 2004

(65) Prior Publication Data

US 2006/0110202 A1 May 25, 2006

(51) Int. Cl.
*B41J 25/00* (2006.01)

(52) U.S. Cl. ..... 400/283; 347/23

(58) Field of Classification Search ..... None
See application file for complete search history.

(56) References Cited

U.S. PATENT DOCUMENTS 5,248,999 A * 9/1993 Mochizuki et al. ..... 347/23
5,446,559 A * 8/1995 Birk ..... 358/473
5,798,773 A * 8/1998 Hiramatsu et al. ..... 347/19
6,042,214 A * 3/2000 Minowa et al. ..... 347/23
6,340,217 B1 * 1/2002 Ebisawa et al. ..... 347/23
6,382,764 B1 * 5/2002 Shimoda ..... 347/23
7,047,160 B2 * 5/2006 Robins ..... 702/184

FOREIGN PATENT DOCUMENTS

JP 55079189 A * 6/1980
JP 2004220560 A * 8/2004

* cited by examiner

*Primary Examiner*—Daniel J. Colilla
*Assistant Examiner*—Jill E. Culler
(74) *Attorney, Agent, or Firm*—George M. Macdonald; Angelo N. Chaclas

(57) ABSTRACT

A system and method for providing a self-diagnostic process for determining a print shaft contamination condition such as debris build up on the guide shaft in a shuttle head printer is described. The process can be carried out at several points in time including automatically when the printer is powered-up, at a periodic schedule, and/or at the initiation of a user. The process includes a measurement of the print head speed over a travel distance along the guide shaft. If the speed is lower than a predetermined threshold value, the user is notified that a print shaft contamination condition exists.

20 Claims, 2 Drawing Sheets

PRINT SHAFT CONTAMINATION DETECTOR

BACKGROUND

The present invention relates generally to a printers and, more particularly, to shuttle head printers.

In shuttle head printers, such as dot-matrix printers, inkjet printers and bubble-jet printers, the print head assembly travels across a print media such as a sheet of paper or a mail piece, marking the media such as by rendering ink on the media one band at a time. The printer advances the print media under the print head assembly after printing a band in preparation for the next band. The print head assembly then traverses back across the print media, rendering the next band. The back and forth movement interspersed with media motion continues until the printing on the media is completed. One of the factors determining the overall throughput of the printer is the speed at which the print head assembly is able to traverse the print media. A typical inkjet shuttle head printer includes a print head assembly that consists of plastic print head holder, which secures one or more print cartridges. Two metal bearings are molded into the holder for guiding the print head assembly along a polished steel guide shaft. A ribbon cable assembly is connected to the print head assembly using a set of contact points for providing electrical connections with the print cartridges.

As the printer is used over a period of time, debris such as dust resulting from the media handling and printing accumulates on the guide shaft. The dust is also mixed with the lubricants leached from the bearings. When the guide shaft becomes dirty, it slows down the print head speed and significantly reduces the overall throughput of the printer. When that happens, the guide shaft must be cleaned. Some printers include a shuttle motor test feature, but do not test for a print shaft contamination condition. Certain printers rely on technicians to perform maintenance after a failure caused by print shaft contamination. Yet other printing systems reduce throughput due to the contamination condition without any warning or feedback to the operator.

Accordingly, there is a need for a printing system that is capable of testing for a print shaft contamination condition and for providing a warning to a printer operator.

SUMMARY

The present application describes illustrative embodiments for providing a self-diagnostic process for determining a print shaft contamination condition such as debris build up on the guide shaft in a shuttle head printer. The process can be carried out at several points in time including automatically when the printer is powered-up, at a periodic schedule, and/or at the initiation of a user. The process comprises a measurement of the print head speed over a travel distance along the guide shaft. If the speed is lower than a predetermined threshold value, the user is notified.

DETAILED DESCRIPTION OF EMBODIMENTS

Figure 1:
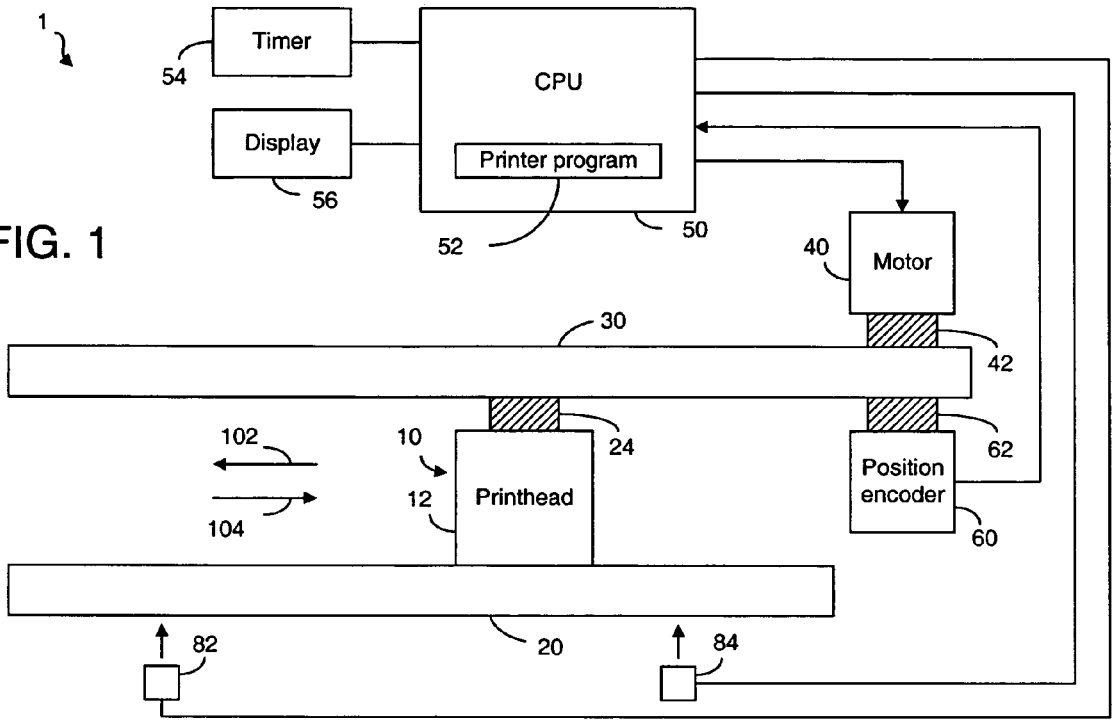
FIG. 1 is a schematic representation illustrating a shuttle head printer with speed measurement components according to an illustrative embodiment of the present application.

It is thus advantageous and desirable to provide a system and method for determining a print shaft contamination condition such as by automatically determining when a threshold contamination level is reached in order to alert the operator to the condition so that the operator may clean the guide shaft.

The present application describes several illustrative embodiments for providing a printer self-diagnostic procedure to determine whether certain parts of the printer have become so contaminated that they require cleaning. In at least one embodiment, this self-diagnostic procedure is implemented using typical shuttle head printer components with an improved controller programmed with a routine to perform a diagnostic check to determine if there is a dirty print shaft condition. A shuttle motor test program may be modified to perform the print shaft contamination detection routine. The routine may be performed initially at printer start-up, when requested by the user or at another time. Additionally, there may be more than one threshold value set and such value may be preset or controlled by the operator. In the illustrative embodiments described, a representative print shaft contamination condition includes contamination in the form of debris from paper dust mixed with leached lubricants from the printer bearings that has built up on a polished steel guide shaft.

A shuttle head printer typically includes a print head assembly that includes a print head holder that includes a molded plastic frame that holds one or more print head cartridges. The print head holder typically includes two bronze bearings molded into the plastic frame that engage a polished steel print head guide shaft. The guide shaft provides linear motion stabilization for the print head assembly. A ribbon cable typically is utilized to provide a set of electrical contact points for completing an electrical connection to the movable print head assembly and print head cartridges. A typical printer includes a user interface having a set of buttons and/or keys and a Liquid Crystal Display (LCD) for use in communicating with a printer operator. A position encoder is typically used to provide absolute position data of the print head assembly to the printer controller. The information is used in a feedback loop to provide real time control information used to control the shuttle motor.

The shuttle motor is typically a DC motor that drives the lateral reciprocating motion of the print head assembly using a screw drive or drive belt to convert rotational motion into linear motion. The controller typically includes a microprocessor that controls the speed and direction of the motor using the encoder data in order to accelerate or decelerate the print head along the guide rail. The slew speed of the print head assembly is typically defined as rapid movement that is used to make gross movements and is independent of print quality. A shuttle jam condition is typically defined as a condition that blocks the ability of the shuttle motor to move the print head assembly across the printer.

Referring to FIG. 1, a schematic representation of an illustrative shuttle head printer with speed measurement components is described. A shuttle head printer 1 comprises a print head assembly 10, which is propelled along a guide shaft 20. The guide shaft 20 provides linear motion stabilization for the print head assembly 10. A driving mechanism, such as a DC motor 40, sets a belt or a drive shaft 30 in motion. The drive shaft 30, together with a mechanical coupling 42, transfers the rotational motion of the motor 40 into a linear motion. The drive shaft 30 is operatively connected to the print head assembly 10 through a connection mechanism 24 so as to move the print head assembly 10 along the guide shaft 20. The connection mechanism includes a ribbon cable, but alternatively a wireless connection may be used. At the same time, a position encoder, such as an optical encoder 60, is used to obtain the absolute position of the print head assembly 10 on the guide shaft 20.

The position information obtained by the position encoder 60 is fed to a processor such as a microprocessor or central processing unit (CPU) 50 so as to allow the CPU 50 to provide real-time control for the motor. Thus, the motor 40, the position encoder 60 and the CPU 50 form a feedback loop to control the motion of the print head assembly 10. The motor 40 and the position encoder 60 are fixedly attached to each other, and the print head assembly 10 is mechanically affixed to the drive shaft 30. When the motor 40 turns, the rotational motion is converted into linear movement to propel the print head assembly 10 along the linear guide shaft 20. Controlled print head assembly motion is achieved through the use of a printer control program 52 usually embedded in the CPU 50. The printer control program includes a shuttle motor test routine that is modified to include the print shaft contamination detection process. Before sending electrical current to the motor 40, the printer program instructs the microprocessor to read the position encoder 60 and determines the current position of the print head assembly 10. Based on the current position and a target position of the print head assembly 10, the printer program determines which direction the motor must turn.

The printer program 52 also determines the distance over which the print head assembly will traverse. The printer program 52 causes the CPU 50 to apply an electrical current to the motor. The value of the electrical current is determined at least in part by the distance between the actual position and the desired position of the print head assembly. As the CPU continuously reads the position encoder, it makes adjustments to the electrical current based on the actual position and the desired position of the print head assembly. Using this feedback-loop method, the printer program is able to achieve a controlled acceleration and deceleration of the print head assembly. This controlled motion method is known in the art.

However, problems can develop at the interface between the print head assembly 10 and the guide shaft 20. When debris coats the guide shaft, the friction at the interface increases. This will cause the overall traveling speed of the print head assembly to decrease. The present invention provides a method of printer self-diagnosis such that when the reduction of overall traveling speed of the print head assembly reaches a certain limit, a user is so notified.

Figure 2:
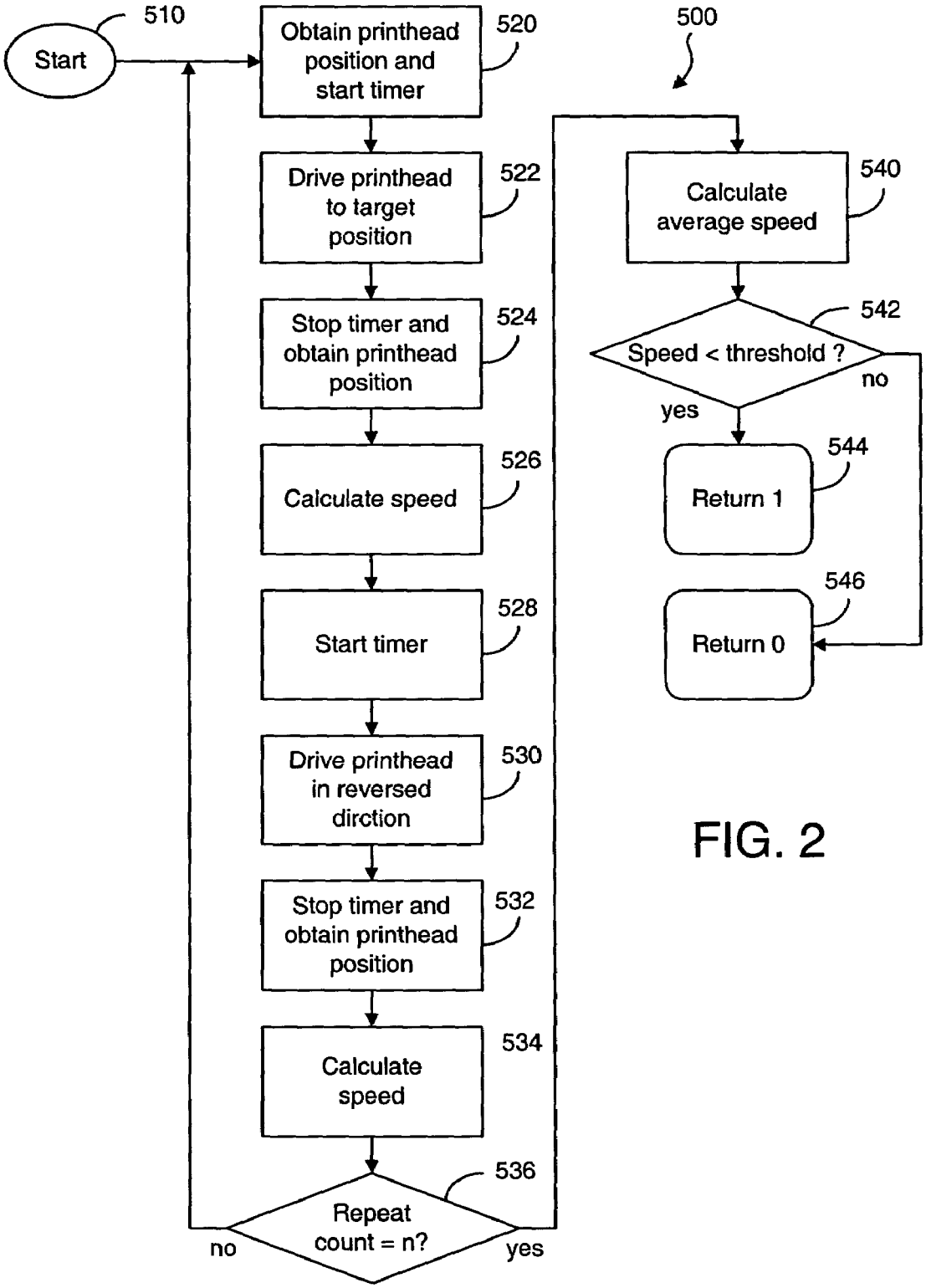
FIG. 2 is a flowchart showing a printer self-diagnostic procedure according to an illustrative embodiment of the present application.

Referring to FIG. 2, a self-diagnostic procedure, according to an embodiment of the present application is illustrated in process 500. The process 500 uses a timer 54 under the control of the CPU 50 to measure the time for the print head assembly to travel a certain distance. Accordingly, the actual speed of the print head assembly may be calculated and compared to an expected speed. Alternatively, an expected time of travel over a distance may be compared to a measured time of travel over a distance. The timer 54 is included in CPU 50, but alternatively may be a separate device. The distance traveled by the print head assembly is measured through the reading of the position encoder at two different print head assembly positions. As shown in the flowchart, the procedure starts at step 510. At start, the printer program instructs the CPU to run the motor at maximum or slew speed. However, before an electrical current is applied to the motor, the position encoder is read in order to determine the current position of the print head assembly, as shown at step 520. As soon as the motor is turning, the timer 54 starts counting in milliseconds. Other known timing system may be used as an alternative to provide sufficient resolution and accuracy for the desired threshold within a desired tolerance range. At step 522, the print head assembly is driven from its original position to a target position. As soon as the position encoder indicates that the print head assembly has reached the target position, as shown at step 524, the time stops counting. From the distance as measured by the position encoder readings and the counts on the timer, the CPU computes at step 526 the speed of the print head assembly on this traveling distance. Now the traveling direction of the print head assembly is reversed. As soon as an electrical current is applied to the motor to drive the print head assembly toward its original position, the timer starts counting again, as shown at steps 528 and 530. When the position encoder indicates that the print head assembly has been driven back to its original position, the timer stops counting, as shown at step 532. The speed of this second journey of the print head assembly is again calculated and the average roundtrip speed is obtained. Alternatively, other performance measurements may be used to infer that the print shaft is contaminated. For example, the speed during part or all of an actual printing pass may be measured. Similarly, the duration of a printing pass may be measured.

It is possible to use the measured speed during or duration of one roundtrip to determine the contamination condition. However, it may be desirable to make a number of repeated runs in order to obtain a more accurate speed or duration measurement. Thus, until the desired number of trips have been made, the speed measurement process loops back to step 520. When the desired number of trips has been made as determined at step 536, the average speed of all trips is calculated at step 540. If the speed falls below a predetermined threshold value as determined at step 542, a value of 1 is returned at step 544 and the user is notified of such condition. The user should clean the guide shaft in order to increase the print head speed. Otherwise, a value of 0 is returned at step 546, indicating that the contamination on the guide shaft has not reached to a point where cleaning is recommended or required. In an alternative, the user sets the threshold value. In another alternative embodiment, multiple threshold values are presented and the user is prompted to determine if, for example, the middle level throughput is sufficient for the job. Accordingly, a maintenance procedure might not be indicated until required. In yet another alternative embodiment, the user is prompted for a throughput value and the printer determines whether it can meet that level of throughput based upon the measurement described above.

In measuring the speed of the print head assembly, it is possible to allow the print head assembly to traverse the print width, which is equal to 9 inches (22.9 cm) in some printers. A speed measured in inch/milliseconds should be sufficiently accurate for this diagnostic procedure. The threshold speed value can be set at 75% of the ideal speed, for example. This ideal speed can be measured when the printer is new or when the guide shaft is cleaned using the same speed measurement procedure. This ideal speed can be stored in the CPU so that it can be used as the 100% speed reference.

A printer is usually equipped with an information display, such as an LCD display 56. When the speed of the print head assembly falls below the threshold value, a message can be posted on the LCD display so as to alert the user. However, it is also useful to post the speed of the print head assembly regularly even before the contamination on the guide shaft has become severe. In alternative embodiments, the current throughput capability is displayed to the user.

Accordingly, at least one benefit of the illustrative embodiments described in the present application is making the user aware of an unacceptable contamination condition. Thus, it is not necessary for the user to perform periodic cleaning. Additionally, the illustrative embodiments described can be useful in preventing the occurrence of a jam condition because the contamination would never reach to a point where the friction at the guide shaft overcomes the ability of the motor to move print head assembly.

The illustrative self-diagnostic procedures described make use of the components usually existing in a shuttle head printer. Thus, only the printer program 52 has to been modified. However, referring to FIG. 1, it is also possible to optionally dispose a pair of sensors 82, 84 at a fixed distance along the guide shaft to stop and start the timer 54. For example, it is possible to use a pair of opto-interrupters or a pair of contact switches to sense the arriving of an edge 12 of the print head assembly 10. As the sensors 82, 84 are operatively connected to the timer 54 or the CPU 50, the CPU 50 can obtain the time between the sensing signals from these sensors to calculate the speed of the print head assembly.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method for determining when maintenance should be performed on a printer having a movable print head comprising:

causing the print head to move a predetermined distance, obtaining the length of time for the print head to move said predetermined distance, and annunciating a maintenance condition if the length of time is greater than a predetermined time duration, further comprising calculating the average speed of the print head based upon said predetermined distance and said obtained length of time so that said annunciating is dependent upon whether the average speed exceeds a predetermined speed.

2. The method of claim 1, wherein said obtaining of the length of time for the print head to move said predetermined distance is performed by a use of an encoder in cooperative engagement with the print head and a timer associated with the movement of the print head, and wherein the encoder generates a count proportioned to the movement of the print head, and the timer measures the length of time that the print head takes to move the predetermined distance that is based upon the count of the encoder.

3. The method of claim 1, wherein the print head is cooperatively engaged with a guide shaft for movement, and the predetermined distance is with respect to movement of the print head relative to the guide shaft, and wherein said obtaining of the length of time for the print head to move said predetermined distance is performed by a use of an encoder in cooperative engagement with the guide shaft and a timer associated with the movement of the print head, and wherein the encoder generates a count proportioned to the movement of the print head, and the timer measures the length of time that the print head takes to move the predetermined distance that is based upon the count of the encoder.

4. The method of claim 3, wherein the predetermined distance comprises more than one transversal movement of the print head between two spaced apart positions of the guide shaft.

5. The method of claim 1, wherein said determining is performed at the time the printer is powered up.

6. The method of claim 1, wherein said determining is performed periodically.

7. The method of claim 1, wherein said determining is performed in response to an action of a user of the printer.

8. A printer comprising:

a movable print head;

a position sensing system; and a processor for determining a print shaft contamination condition, wherein the processor is programmed for:

causing the print head to move a distance;

determining a performance measurement value, and indicating a print shaft contamination condition if the performance measurement value is lower than a threshold value.

9. The printer of claim 8, wherein the distance is a predetermined distance; and determining the performance measurement value includes obtaining the length of time for the print head to move said distance.

10. The printer of claim 9, wherein the processor is further programmed for indicating a print shaft contamination condition if the length of time is greater than a predetermined time duration.

11. The printer of claim 9, wherein determining the performance measurement value includes obtaining the speed of the print head.

12. The printer of claim 11, wherein determining the performance measurement value includes obtaining the speed of the print head during a printing operation.

13. The printer of claim 9, wherein said obtaining of the length of time for the print head to move said distance is performed by a use of:

an encoder in cooperative engagement with the guide shaft; and a timer associated with the movement of the print head, and wherein the encoder generates a count proportioned to the movement of the print head, and the timer measures the length of time that the print head takes to move the predetermined distance that is based upon the count of the encoder.

14. The printer of claim 8, further comprising:

an encoder in cooperative engagement with the print head and a timer associated with the movement of the print head, and wherein the encoder generates a count proportioned to the movement of the print head, and the timer measures the length of time that the print head takes to move the distance that is based upon the count of the encoder.

15. The printer of claim 8,further comprising:

a guide shaft cooperatively engaged with the print head; and the distance is measured with respect to movement of the print head relative to the guide shaft.

16. The printer of claim 15, wherein the distance comprises more than one transversal movement of the print head between two spaced apart positions of the guide shaft.

17. The printer of claim 16, wherein the spaced apart positions of the guide shaft are based upon an overall movement that the print head can maximally traverse along said guide shaft.

18. The printer of claim 8, wherein said determining is performed in response to an action of a user of the printer.

19. A method for determining when maintenance should be performed on a printer having a movable print head comprising:

causing the print head to move a predetermined distance, obtaining the length of time for the print head to move said predetermined distance, and annunciating a maintenance condition if the length of time is greater than a predetermined time duration, wherein the print head is cooperatively engaged with a guide shaft for movement, and the predetermined distance is with respect to movement of the print head relative to the guide shaft, and wherein said obtaining of the length of time for the print head to move said predetermined distance is performed by a use of an encoder in cooperative engagement with the guide shaft and a timer associated with the movement of the print head, and wherein the encoder generates a count proportioned to the movement of the print head, and the timer measures the length of time that the print head takes to move the predetermined distance that is based upon the count of the encoder, and wherein the predetermined distance comprises more than one transversal movement of the print head between two spaced apart positions of the guide shaft.

20. The method of claim 19, wherein the spaced apart positions of the guide shaft are based upon an overall movement that the print head can maximally traverse along said guide shaft.

* * * * *